US007743907B2

(12) United States Patent
Weinbrenner et al.

(10) Patent No.: US 7,743,907 B2
(45) Date of Patent: Jun. 29, 2010

(54) TRANSPORT SYSTEM FOR CONTAINER PROCESSING MACHINES

(75) Inventors: Volker Weinbrenner, Schierling (DE); Karl-Heinz Achhammer, Wörth/Donau (DE); Roland Laumer, Regensburg (DE); Heinrich Bielmeier, Pilsting-Grosskollnbach (DE)

(73) Assignee: Krones AG, Neutraubling (DE)

( * ) Notice: Subject to any disclaimer, the term of this patent is extended or adjusted under 35 U.S.C. 154(b) by 327 days.

(21) Appl. No.: 11/658,624

(22) PCT Filed: Jan. 31, 2006

(86) PCT No.: PCT/EP2006/000791

§ 371 (c)(1),
(2), (4) Date: May 29, 2007

(87) PCT Pub. No.: WO2006/087088

PCT Pub. Date: Aug. 24, 2006

(65) Prior Publication Data

US 2008/0115854 A1 May 22, 2008

(30) Foreign Application Priority Data

Feb. 16, 2005 (DE) ..... 20 2005 002 470 U

(51) Int. Cl.
*B65B 43/42* (2006.01)

(52) U.S. Cl. ..... 198/459.2; 198/608; 198/860.1; 141/144; 141/168

(58) Field of Classification Search ..... 198/397.03, 198/459.2, 479.1, 480.1, 608, 723, 860.1, 198/861.1; 141/168, 144
See application file for complete search history.

(56) References Cited

U.S. PATENT DOCUMENTS

| | | | | |
|---|---|---|---|---|
| 5,236,337 | A * | 8/1993 | Kikuchi et al. | 177/52 |
| 5,261,207 | A | 11/1993 | Bedin | |
| 5,439,095 | A * | 8/1995 | Lentz et al. | 198/480.1 |
| 6,058,985 | A * | 5/2000 | Petri et al. | 141/168 |
| 6,848,564 | B2 * | 2/2005 | Nickey et al. | 198/379 |
| 2003/0116404 | A1 * | 6/2003 | Preti et al. | 198/459.3 |
| 2006/0086061 | A1 * | 4/2006 | Bernhard | 53/281 |
| 2006/0086410 | A1 | 4/2006 | Bernhard | |

FOREIGN PATENT DOCUMENTS

| | | |
|---|---|---|
| EP | 0939044 | 9/1991 |
| EP | 0901974 A2 | 3/1993 |
| EP | 0631561 | 1/1995 |
| EP | 0743267 A1 | 11/1996 |
| EP | 0795500 A2 | 9/1997 |
| EP | 1316520 A1 | 6/2003 |
| EP | 1645537 A1 | 4/2006 |

* cited by examiner

*Primary Examiner*—Mark A Deuble
(74) *Attorney, Agent, or Firm*—Marshall, Gerstein & Borun LLP

(57) ABSTRACT

A transport system for container processing machines, particularly for bottle fillers, with inlet and outlet stars, which can be driven and are arranged on columnar support housings, and define a star configuration, in which the inlet and outlet stars define container transport paths which are linked with the machine. Each support housing presents at least one, preferably lateral, connection interface, to which a joining end of a connection strut is attached, in a removable manner. The other joining end of the connection strut is connected, in a detachable manner, to a connection interface of an additional support housing or of a machine substructure. In each case, in such manner, the star configuration can be changed as desired in a modular manner.

17 Claims, 7 Drawing Sheets

TRANSPORT SYSTEM FOR CONTAINER PROCESSING MACHINES

CROSS-REFERENCE TO RELATED APPLICATION

Figure 1:
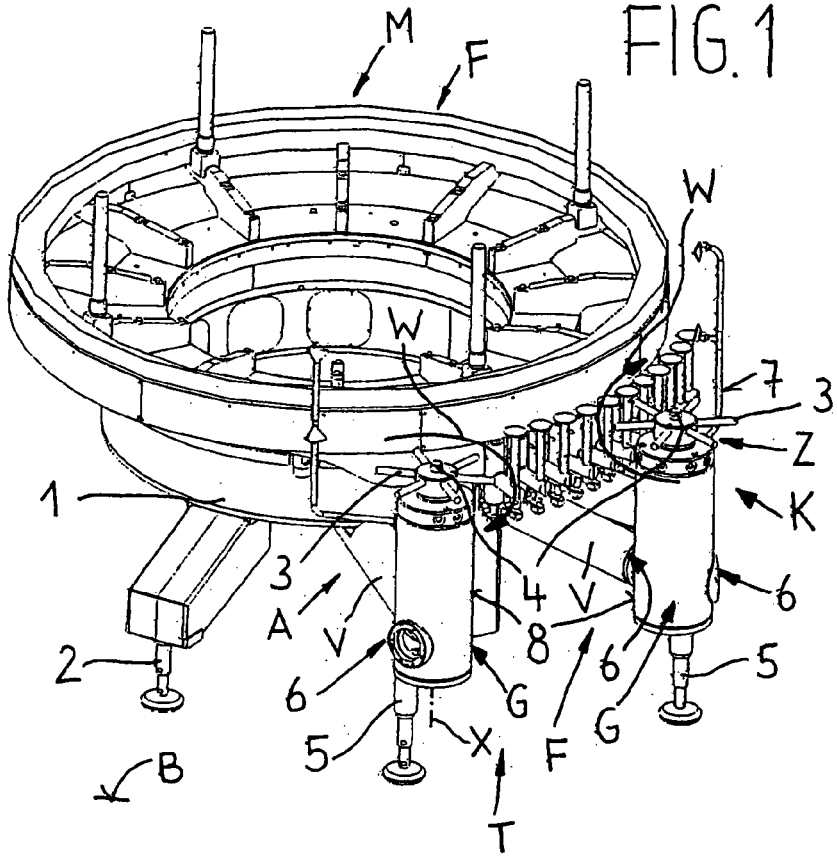

This is the U.S. national stage under 35 U.S.C. §371, of international application no. PCT/EP2006/000791, having an international filing date of Jan. 31, 2006, and claims priority to German application no. 20 2005 002 470.8 filed on Feb. 16, 2005.

FIELD OF THE DISCLOSURE

The disclosure relates to a transport system used in container processing machines, such as for bottling operations.

BACKGROUND OF THE DISCLOSURE

Container processing machines, such as, bottle fillers, in the past presented a processing table which was firmly attached to the machine and in which the inlet and outlet stars, and optionally transfer stars, were built in with a fixed mutual arrangement and also a fixed arrangement with respect to the machine. This concept is being questioned today, for microbiological reasons and because it is difficult to clean. Furthermore, the star configuration is established and not variable, i.e., tailored to fit a given application.

The transport system known from EP 0 901 974 A and U.S. Pat. No. 6,058,985 A is constructed on a support plate, which covers the star drive systems and is located under the transport plane which consists of hoods that are rigidly interconnected by casting or welding, and which stands with legs on the floor. The hoods carry the support housings of the stars, which are narrower than the hoods. Although this concept is slightly better than the previous processing table solutions with regard to microbiological conditions and cleaning, the support plate nevertheless covers an unnecessarily large floor area, and, between the hoods there are intersecting areas and angles in which dirt becomes fixed. Furthermore, the star configuration, which is not variable and fixed by the support plate, is a drawback; in fact, it is tailored so to speak to each given application. In an embodiment, the drive systems of the stars can be driven separately.

The transport system known from EP 1 316 520 A, which is operatively assigned to a bottle filler and a rinser, is constructed on a duct carrier in the shape of an arc of a circle, which stands on the floor, and in which several seats for stars and other installations are integrated, and in which additionally rigidly positioned storage places for other installations are incorporated. In the seats, stars can be mounted, which present their own drive motors. Different numbers and types of stars can be chosen depending on the application, nevertheless, the shape of the duct carrier in the form of an arc of a circle does not allow any variability worth mentioning. The concept is also not satisfactory from the microbiological point of view.

SUMMARY OF THE DISCLOSURE

The disclosure is based on the problem of improving a transport system of the type mentioned in the introduction with regard to microbiology, ease of cleaning, and especially variability.

The support housings, which can be in the shape of slender torpedoes, are positioned and stabilized via connecting struts inside the star configuration in such a manner that the stars are in their operatively required positions. Here, either adjacent support housings are connected each by one connection strut and/or at least one support housing is connected to the machine substructure. The connection interfaces and the connection struts, however, can form various chosen star configurations, because they can be compatible if desired, and they allow the addition or removal of support housings or stars as a function of the given application. Because no physical processing table is provided, and to form sufficiently large free spaces around the support housing down to the floor, hygienically perfect microbiological conditions can be achieved, and the cleaning cycles can be run effectively and rapidly. In fact, the arrangement is a modular construction set system, within which one can assemble components or modules that have at least one connection interface as needed to form a virtually stable processing table transport system, which avoids the drawbacks that to date had to be tolerated with the physical processing table. This column-beam system allows an optimal variability with regard to any desired star wheel configurations. The design concept of the transport system allows particularly advantageously the removal of a star with defective function, completely with the support housing, and its replacement by a similar star, without having to remove or modify the appropriate positions of the other stars.

The connection interfaces of the support housing and the joining ends of the connection struts are particularly advantageously substantially identical in construction, and preferably even identical, so that mutual substitution and feasibility are ensured.

The connection struts, with the exception of their length and optionally their wall thicknesses, present at least substantially the same construction, with regard to the external dimensions, and are preferably identical. Using one construction set of connection struts having different lengths, which optionally may have large wall thicknesses in the case of components or modules of higher weight, many different star configurations can be used using the connection interfaces. In the process, the connection struts, some of which may even be solid profiles, should present an external circumference which ensures that, in the mounted position, no horizontal or deep surfaces on the top side are formed, but only surfaces that are as smooth as possible, from which liquids can easily run off. They can be U-shaped profiles in rotated arrangement or closed hollow profiles having a great variety of profiles, each presenting as small a width as possible in the viewing direction towards the floor, to achieve high stability or rigidity.

The support housings, particularly for the cleaning and in view of the deposition of liquid residues or dirt, should present surfaces that are as smooth as possible and run downward. Round or polygonal external circumferences are advantageous, where it is entirely possible for the support housing also to narrow upward.

In any given formed star configuration, the connection interfaces and the connection struts are located advantageously in a common horizontal plane, which is placed at a distance above the floor and also at a sufficient distance below the transport path plane. For a stable bracing of the support housing, the horizontal plane is at a height such that the containers, for example, bottles of a great variety of types, can never collide with the connection struts.

Although, for many support housings, a single connection interface would be sufficient, in the case of support housings that are, for example, a part of a system component in an end position, it would be advantageous for each support housing to present at least two connection interfaces, preferably with circumferential offset, to allow modular expansion possibilities or reduction possibilities for the transport system with a high degree of freedom. The connection interfaces, in the case of a support housing with at least two connection interfaces, are advantageously offset by an angle which is different from 180°, advantageously by approximately 126°, about the axis of the support housing. This arrangement allows a space-saving zig-zag arrangement, which can be advantageous for the joint working of adjacent stars.

The transport system is stiffened on one side by the connection struts and optionally connected to the machine, where, in an advantageous embodiment, each support housing presents only one standing leg which rests on the floor. The standing leg can be arranged directly on the support housing, or it can be connected to the connection strut which is connected to the support housing. In an advantageous embodiment, the standing leg of the support housing is arranged with offset with respect to the column axis, so that a large, free, lower support housing opening is usable, for example, for heat removal and/or for the control of, or replacement work on, parts located in the interior. The standing leg can be slender and designed with standing surface that is as small as possible, to facilitate the cleaning of the floor, and to interfere as little as possible in the free space around the support housing on the floor.

In a particularly advantageous embodiment of the transport system, the star drive is located in the support housing, so that it is not in an uncovered position and does not require additional covers or housing installations. The star drive can be accessed at any time from the lower free end of the support housing through the support housing opening.

In an advantageous embodiment, the connection struts are tubular. The external diameter of the tubes is preferably slightly larger than half of the external diameter of the support housing. As a result, the transport system, in the star configuration, has an elegant structure with optimally large free spaces. The tubular cross section not only presents optimal stiffness properties, it also provides a closed hollow space for placing lines (for example, for pressurized air, cleaning fluid), cables, or for the passage of drive lines (shafts, traction means).

In a particularly advantageous embodiment, each support housing contains an individual star drive, so that no voluminous drive lines are necessary. This individual drive can be a servomotor with a gear system, or a direct drive motor, whose rotating field is in an RPM ratio of 1:1 to the star wheel. The connection struts can receive the control, supply and monitoring cables with protection; the cables lead to a control and/or supply unit located at an appropriate place, for example, extending into the machine substructure or from there to the machine control.

In the connection struts, which present a large usable cross section, other lines can also be placed, for example, universal shafts, belt strands or similar parts, if the stars are driven from a central location, or other supply or control lines, cables, hoses, signal lines, and similar parts. The connection struts here not only fulfill their main task, but also position the support housing and provide for its stable bracing.

In an advantageous embodiment, the interfaces—joining places are at least substantially flat transitions, and preferably they are even packed and/or sealed, so that no dirt becomes fixed there, that is so that the cleaning can be carried out easily.

In an advantageous embodiment, the support housing connection interface is a flange, whose external dimension corresponds to the external diameter of the joining end of the connection strut. In the joining end of the connection strut an internal flange is present advantageously, which fits the flange, in such a manner that the connection and possibly centering elements can be arranged so they lie inside.

In the joining places, between the flange and the joining end, centering pins are inserted, for example, to ensure a correct alignment. The flange contains, for example, through holes for the threaded tie rod, which are screwed from the inside of the support housing into the joining end of the connection strut.

In an advantageous embodiment, the support housing is provided above the plane of the connection interface with at least one additional auxiliary connection device. Here, as desired, peripheral modules or components, for example, a sloshing cleaning device or a container identifying device can be mounted. The corresponding control or supply lines for this purpose are led into the interior of the support housing and from there through a connection strut.

In an advantageous embodiment, the star configuration can be changed in a modular manner by the addition and/or removal of at least one transfer star, whose support housing can be connected in a detachable manner at connection interfaces by means of at least one connection strut to at least an additional support housing or even to the machine substructure.

In another advantageous embodiment, the star configuration is changed in a modular manner by the addition and/or removal of at least one container processing assembly, for example, a rinsing device, a closing device, a conveyor, inspector, or similar device at connection interfaces. This container processing assembly as well as advantageously presents a support housing with at least a connection interface, and it is stabilized and positioned by means of at least one connection strut, which is fixed in a detachable manner to another support housing or to the machine substructure.

Unoccupied connection interfaces and/or joining ends of the connection struts are advantageously closed with dummy plugs, to prevent the penetration of fluids or dirt.

In addition to its primary function, namely to position and brace in a stable manner the support housing, connection struts can also be equipped with attachment points that can be uncovered and are located, as desired, on the top and/or bottom side, for example, to allow, as desired, the mounting of peripheral equipment parts and/or even support feet directly to a given connection strut. Such attachment points can also be used, for example, to fix the connection struts to the machine substructure.

According to another important idea, the star configuration, which can be changed in a modular manner, contains even standardized inlet and outlet star modules, which can be adapted to each other in any desired groupings and which present advantageously support housings with mutually identical external diameters. Depending on the manner (floor support, trunk and/or neck gripper system) in which the containers to be transported are handled (handling by the neck in the case of PET bottles with a carrier ring or glass handling in the case of glass bottles), the mutually identical support housings are higher or lower above the connection interfaces. Alternatively, it is conceivable to design the support housings in two parts, so that a part of a support housing, which is positioned above the connection interfaces, can be replaced with a part having another length, or adjusted, preferably continuously, relative to the bottom part, for example, by a telescope construction, optionally with a threaded connection between an upper part and a lower part of a support housing.

By a standardization of the connection struts, which are used for integrating these modules in the star configuration, a universal modular component system with high variability is achieved. A subsequent modification or completion of an already existing installation is possible without any problems and at low cost.

BRIEF DESCRIPTION OF THE DISCLOSURE

Figure 8:
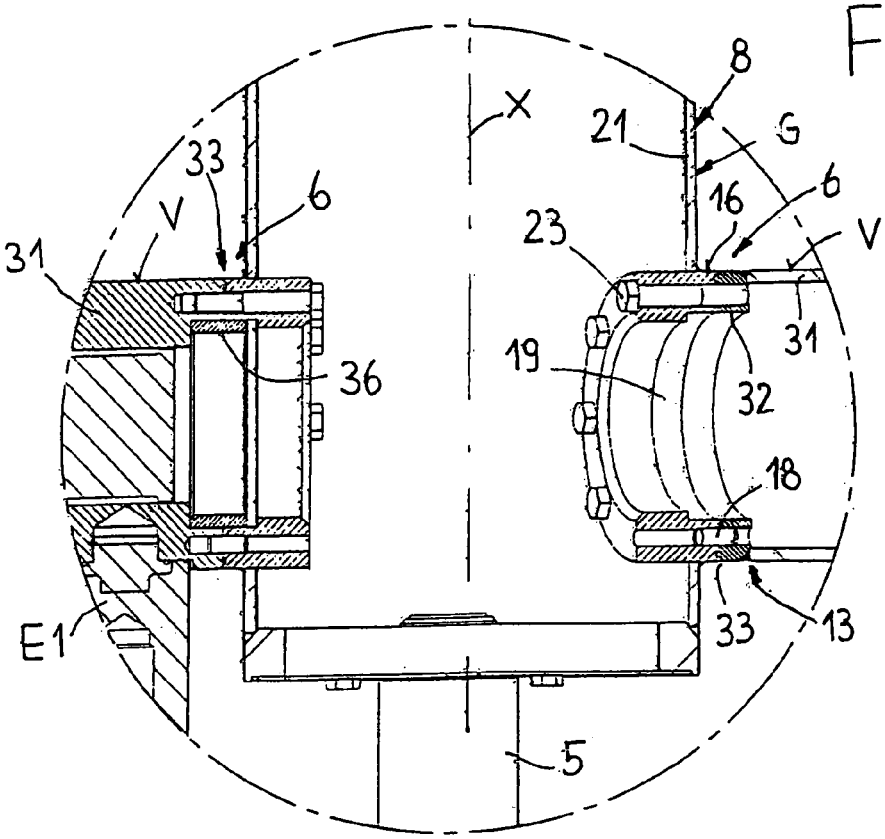
Figure 2:
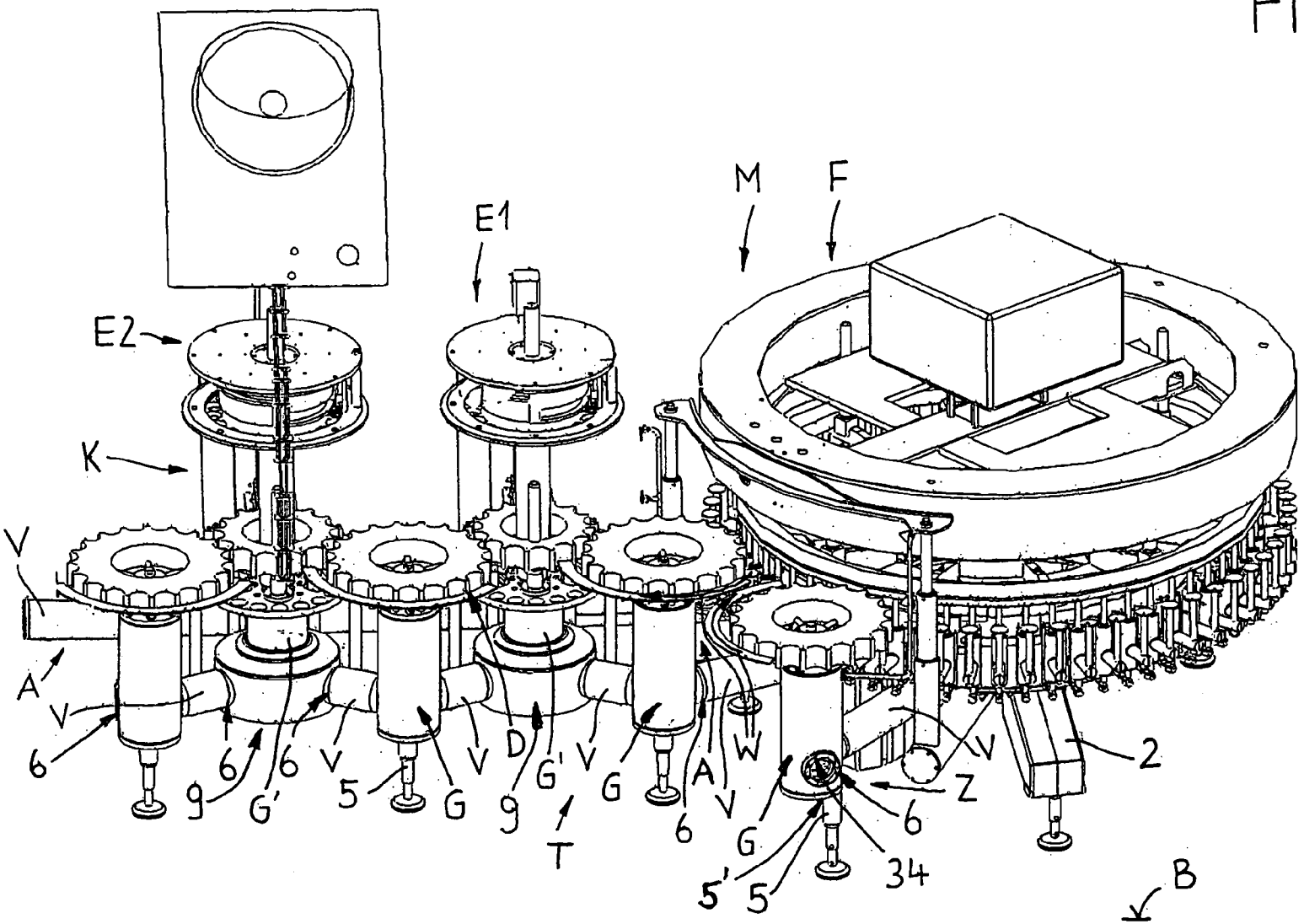
Figure 3:
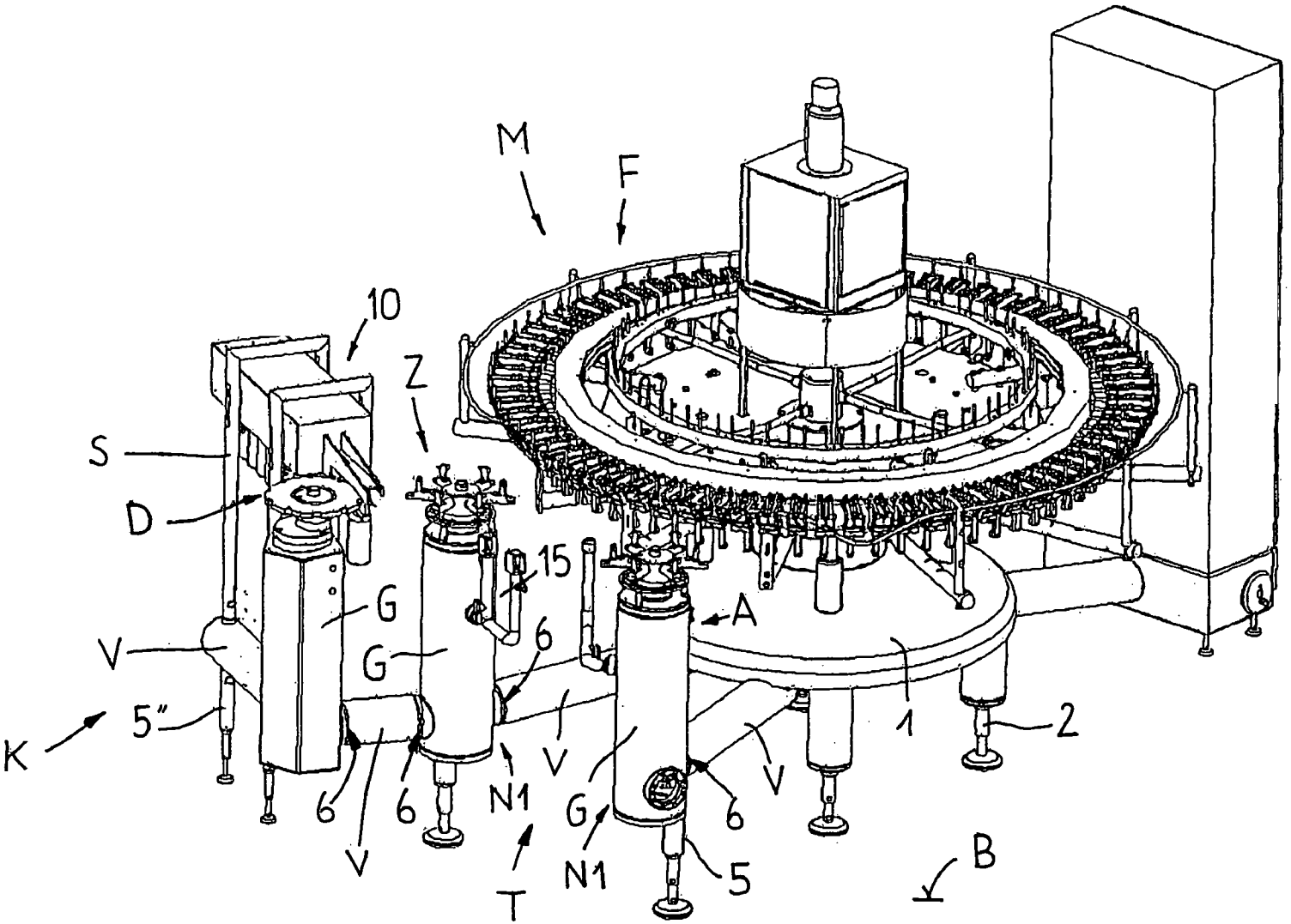
Figure 4:
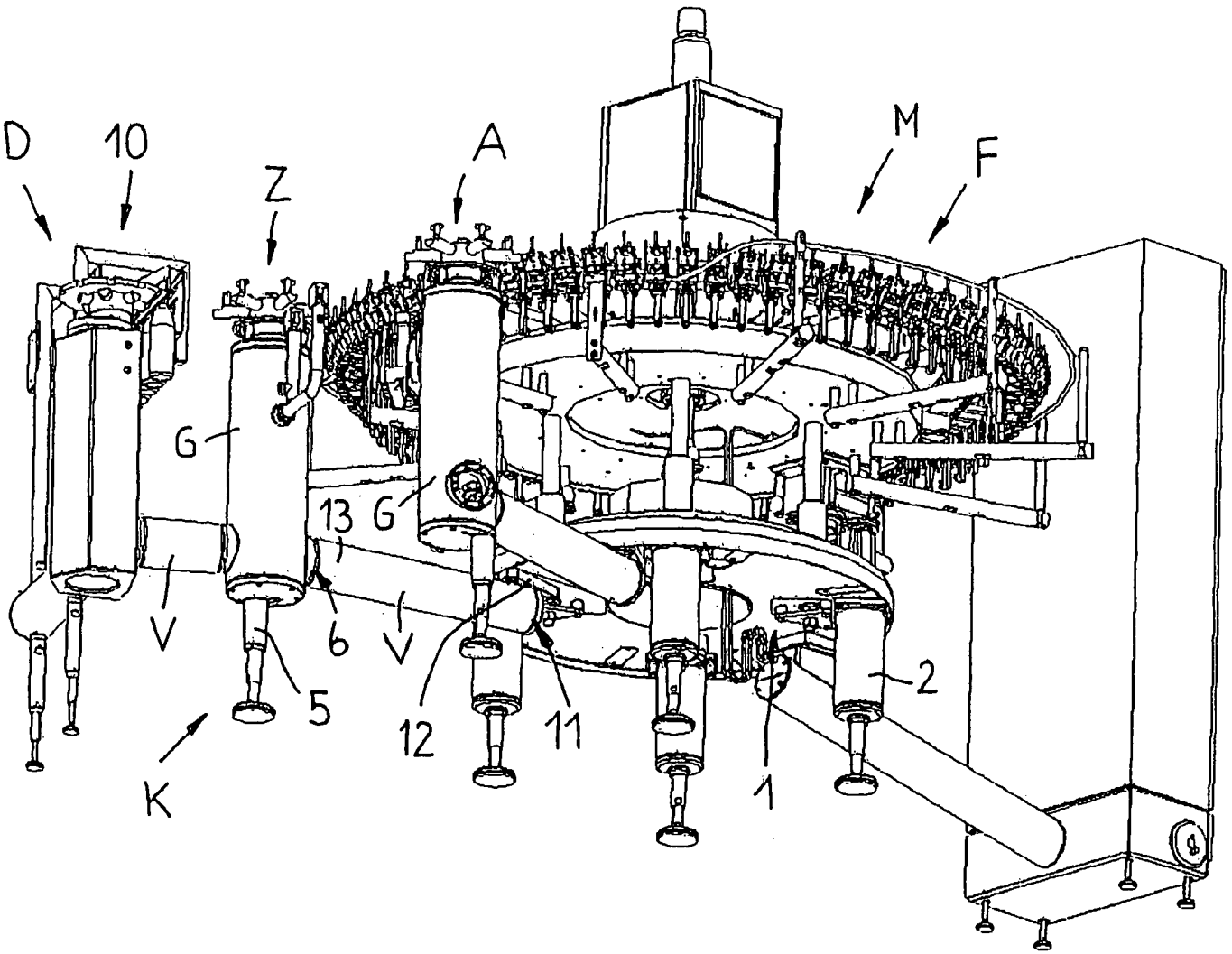
Figure 5:
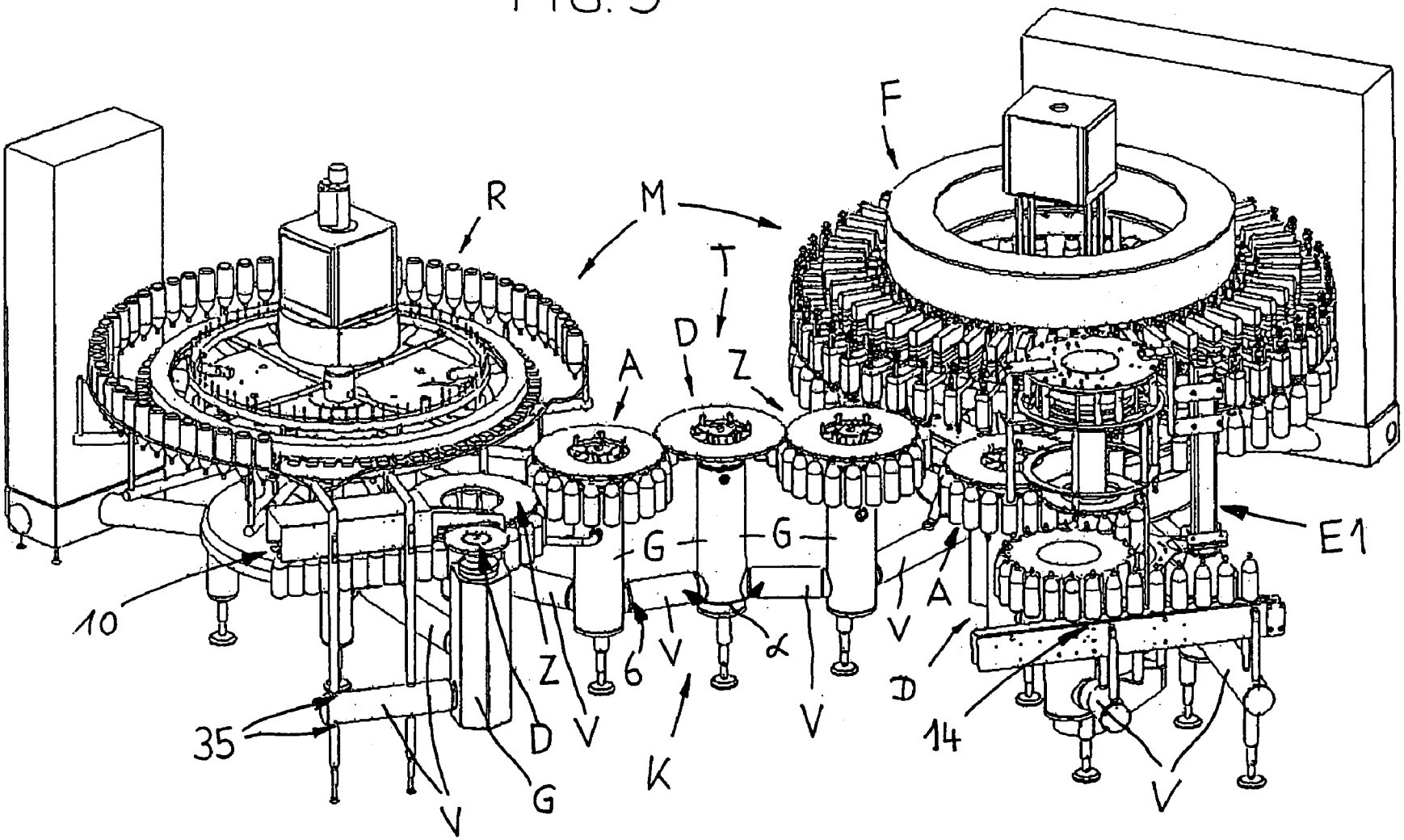
Figure 7:
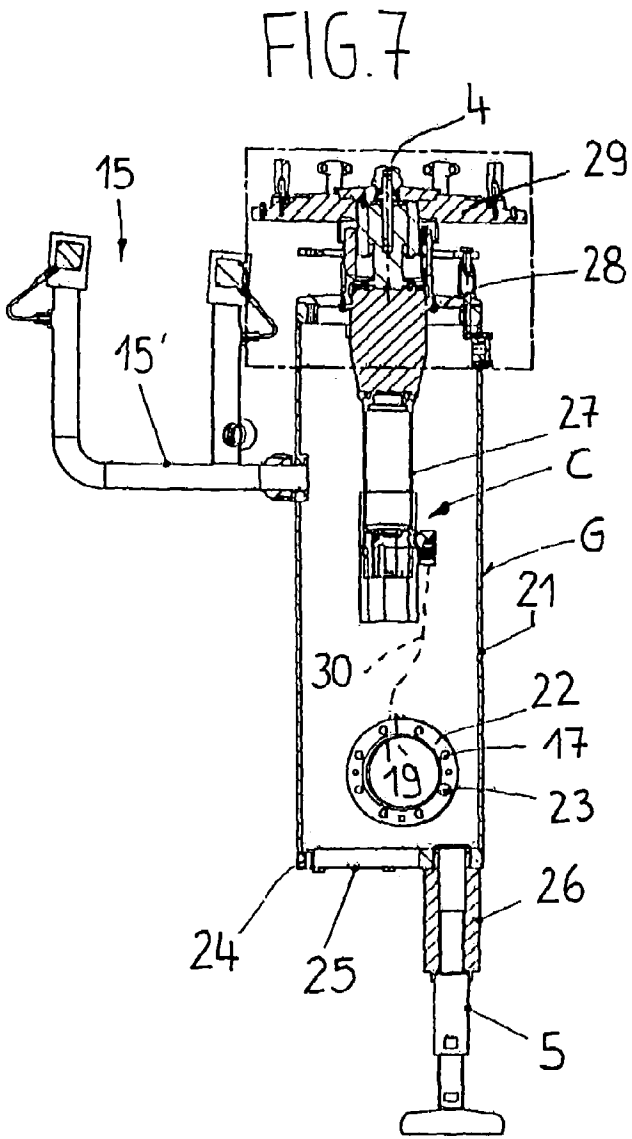
Figure 6:
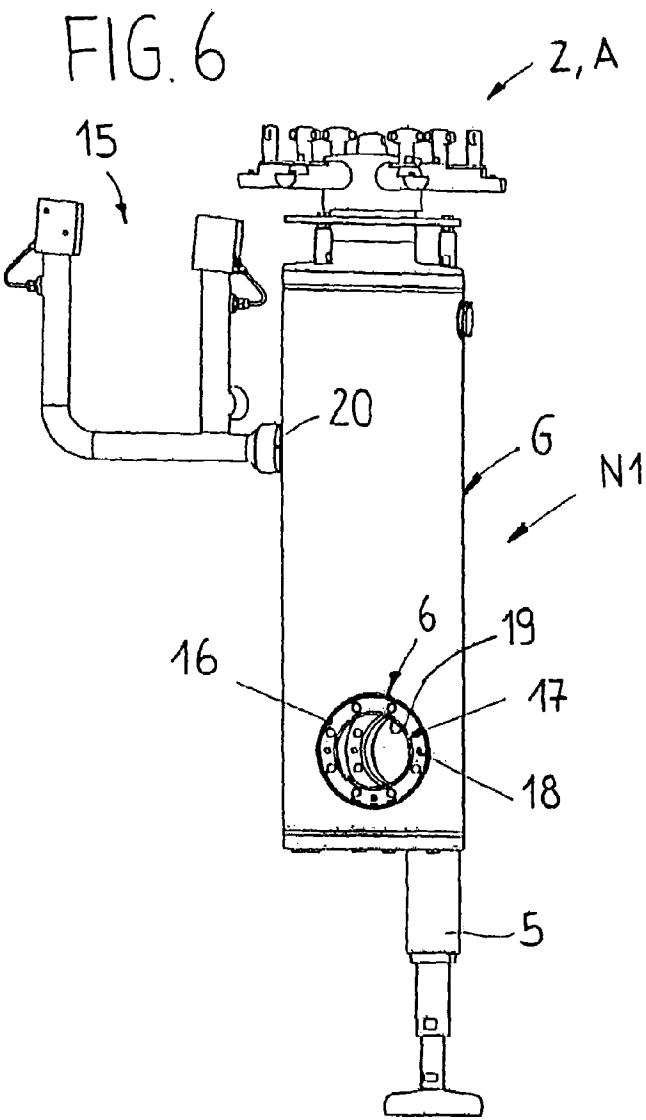
Figure 9:
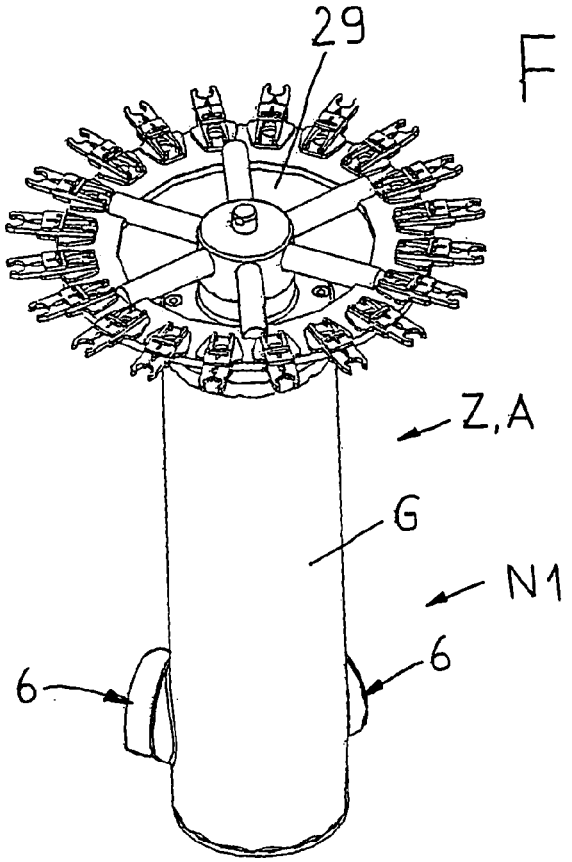
Figure 10:
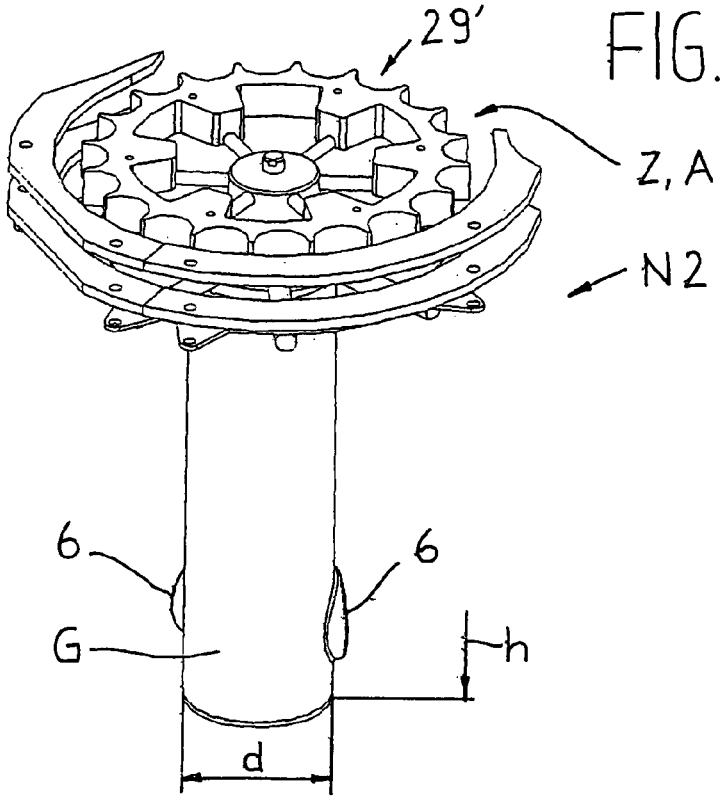

Embodiments of the object of the disclosure are described with reference to the drawing. In the drawing:

FIG. 1 shows a perspective view of a container processing machine with a container transport system, FIG. 2 shows another embodiment of a container processing machine with a transport system which is expanded in a modular manner, FIG. 3 shows an additional embodiment of a container processing machine with a transport system, in a perspective view from above, FIG. 4 shows a perspective bottom view of the embodiment of FIG. 3, FIG. 5 shows a perspective view of a container processing machine with a transport system, in which an additional container processing machine, here a rinsing device, is integrated, FIG. 6 shows a side view of a torpedo-like support housing of a star, where, to simplify, only the basic components of the star are indicated, FIG. 7 shows an axial cross section to FIG. 6, FIG. 8 shows an enlarged axial cross-sectional representation of the connection of connecting struts to a support housing, FIG. 9 shows a perspective view of a standardized star module, by means of which containers can be transported using the neck handling principle, and FIG. 10 is a perspective view of another star module, by means of which containers can be transported using the glass handling principle.

DETAILED DESCRIPTION OF THE DISCLOSURE

FIG. 1 shows a container processing machine M using the example of a bottle filler F (shown without top boiler part), with which a transport system T consisting of an inlet star Z and an outlet star A is functionally associated in a star configuration K, in such a manner that the transport paths W of the stars A, Z are linked with the circumferential path of the machine M. In the star configuration, the stars A, Z are at approximately the same distance from the machine on the floor B, in a delimited circumferential area of the machine M. Of the stars A, Z, only the support structure fragments 3 are shown, to simplify, to which the container-transporting elements are attached in the usual manner.

The machine M presents a substructure 1, which stands with the brackets and support feet 2 on the floor B. Each star A, Z is arranged on the upper part of a support housing G, which carries a drive shaft 4 that can be rotated. Each support housing G is shaped in the shape of a column or a torpedo, and, in the depicted embodiment, it presents a circular external contour with an approximately vertical, smooth external surface 8. Each support housing G possesses a single support leg 5, which is attached with offset relative to the column axis X at the lower end of the support housing G. The support leg 5 can be adjusted individually, particularly to adjust the height position of the support housing G.

Furthermore, in the depicted embodiment, each support housing G has two connection interfaces 6, which are either diametrically opposite each other or which are mutually offset by an angle about the column axis X. The connection interfaces 6 serve the function of connecting connection struts V, by means of which, in the embodiment shown in FIG. 1, each support housing G is braced against the machine substructure 1. However, it would be possible to provide only one connection interface 6 for each support housing G, or more than two connection interfaces 6 could be provided. Furthermore, on the support housing G, above the horizontal plane in which the connection struts V and the connection interfaces 6 are located, a peripheral accessory part could be mounted, for example, a sloshing device 7, which is used for cleaning purposes. The connection struts V are in the form of pipes, for example, made of stainless steel, whose external diameter is approximately more than half of the external diameter of the support housings G, and they are connected in a detachable manner at the connection interfaces 6 with the support housings G or the substructure 1.

In the embodiment in FIG. 2, the container processing machine M is a bottle filler F, with which the transport system T is functionally associated; in this instance, however, the transport system has a star configuration K which has been enlarged in a modular manner compared to FIG. 1.

The inlet star Z, as in FIG. 1, is fixed and positioned with its support housing G by means of a connection strut V to the machine substructure. The support housing G stands with the support leg 5 on the floor B, where, in this embodiment, the support leg 5 is braced against an external, approximately conical, console 5', so that the lower opening of the support housing G, which is not visible in FIG. 2, is completely uncovered.

The unoccupied connection interface 6 is closed hermetically, for example, with a dummy plug 34.

As in FIG. 1, the outlet star A adjacent to the inlet star Z is connected by a connection strut V to the machine substructure. By means of another connection strut V, a support housing G' of a first closing device E1 is connected to the support housing G of the outlet star A, which support housing has a substructure 9 which is held, for example, above the floor B. The support housing G' of the first closing device E1 is connected by means of an additional connection strut V to the support housing G of a transfer star D. The support housing G of the transfer star D is connected by means of another connection strut V to the support housing G' of a second connecting device E2, whose support housing G' is connected by means of a second connection strut V to the support housing G of an outlet star A. An additional, longer, connection strut V is used to brace, for example, components or modules of the closing device E1, E2, and also for stabilization and positioning; it leads, for example, up to the machine substructure.

As shown in FIG. 2, the connection interface 6 on each support housing G, G' are arranged with the same mutual offset by an angle which is different from 180°, so that the connection struts form a zig-zag pattern and produce a stable connection, in which the stars are grouped optimally close to each other.

In the embodiment in FIG. 3, the container processing machine M is a bottle filler F with which a transport system T is operatively associated, which has a different star configuration K, and which comprises the inlet star Z and the outlet star A, each with a support housing G in the form of a torpedo, and additionally comprises a transfer star D (subdivision star wheel) as well as a conveyor 10, for example, an air conveyor for PET bottles. The support housing G of the stars A, Z are fixed in the machine substructure 1 by means of connection struts V which are connected by the boundaries 6. Each support housing G presents, for example, above the plane of the connection interfaces 6 and the connection struts V, a laterally mounted bottle identifier 15.

The stars A, Z are, for example, standardized star modules N1, which transport according to the neck handling principle and which are therefore designed with relatively high support housings G above the connection interfaces 6. The connection interface 6 of the support housing G of the transfer star D is connected to the support housing G of the inlet star Z by means of a relatively short connection strut V, where this support housing G presents, for example, a polygonal circumference with substantially vertical, smooth surfaces. An additional, short connection strut V is connected to the second connection interface 6 of the support housing G of the transfer star D, its end is uncovered, and it is supported by its own support foot 5" on the floor B. The conveyor 10 is positioned by means of struts S, which are mounted above on the connection struts V, to the additional connection strut V and optionally also to the transport housing G of the transfer star D.

FIG. 4 is a perspective bottom view to FIG. 3, which shows how the connection struts V of the support housings G of the stars A, Z are fixed to the bottom side of the machine substructure 1. Here, a joining end 11 of the connection strut V is fixed to the bottom side of an attachment flange 12 of the machine substructure, while the other joining end 13 bluntly abuts against the connection interface 6.

In the embodiment in FIG. 5, the container processing machine M is a bottle filler F, for example, for PET bottles, and a rinsing device R, which are set up on the floor with some distance separating them. The transport system T, with yet another modified star configuration K, is operatively associated with this machine.

The inlet star Z is fixed by means of a connection strut V in the substructure of the bottle filler F. The adjacent support housing G is part of a transfer star D, where, in the direction of transport, upstream of the transfer star D, an outlet star A is positioned, which is fixed with a connection strut V in the substructure of the rinsing device R. Between the support housings G, fixed connection struts also run, where the angle $\alpha$, which differs from 100°, for example, 126°, and which is responsible for the zig-zag configuration of the course of the connection struts V, can be seen clearly. In the substructure of the rinsing device R, by means of an additional connection strut V, an additional inlet star Z is fixed, which is associated with an additional transfer star D and a conveyor 10, for example, an air conveyor. The transfer star D (setting star wheel) is fixed by means of a connection strut V in the substructure of the rinsing device R. Furthermore, on the support housing G of the transfer star D (setting star wheel), which is in a position adjacent to the conveyor 10, a freely ending connection strut V is attached, which stands with its own support feet on the floor and which braces the struts of the conveyor 10. For this purpose, on the connection struts V, upper and/or lower attachment points 35 are provided, which can be uncovered and used, as desired.

In the direction of transport of the bottle filling system F, downstream of the outlet star A, a closing device E 1 is integrated in the transport system T, which feeds an additional transfer star D (lowering star wheel), to which a linear conveyor 14 (conveyor belt) for filled bottles is connected. These components as well are fixed by means of connection struts V to the substructure of the bottle filler and/or on the support housing of the outlet star A. The free ends of the connection struts V are advantageously closed by dummy plugs.

FIG. 6 shows a standardized module N1 of a neck handling inlet and outlet star Z, A with a relatively high support housing G. In addition to the connection interfaces 6, which are located and integrated in the lower area of the support housing G, additional, optionally usable, auxiliary attachment points 20 are provided, for example, to allow the mounting of the bottle identifying device 15 (photoelectric barrier), as shown.

The connection interface 6 is a flange 16, for example, an annular flange, which is welded into the support housing G and which forms an interior passage 19. In the flange 16, through holes 17 and centering pins 18 are provided. In the axial cross-sectional view of FIG. 7, the internal side 22 of the flange 16 with the through holes 17 and an inserted threaded tie rod 23 are shown. The support housing G is, for example, a round, tubular or torpedo-like shaped part made of a refined steel having a wall 21 in the overall shape of a hollow column. In the lower end of the support housing G, a ring 24 is welded, forming a lower, free opening 25, and receiving a sleeve 26 for the support leg 5 which can be screwed in and whose height is adjustable.

In the embodiment in FIG. 7, the support housing G presents an interiorly located drive C for the star, for example, a direct drive motor or a servomotor with a drive which is coupled via a section 27 to a support structure 29 of the star, where the support structure 29 can be driven in rotation about the axle 4. At the upper end, the support housing G is closed by a head plate 28, which contains a rotation bearing. The bottle identifying device 15, which is attached laterally to the support housing, is fixed, for example, with an interiorly hollow braces 15' to the support housing G.

From the drive C, a control and/or supply line 30 extends through the passage 19 into the connection strut (not shown) which is connected there and reaches a control and/or supply unit which is associated, for example, with the machine. Cables, which are not shown, for the bottle identifying device 15 run, for example, also in the interior of the support housing G and through the opening 19 into the connection struts which are connected there.

FIG. 8 illustrates the connection of the connection struts V to the support housing G at the connection interfaces 6 using the flange 16 shown in FIG. 6 and FIG. 7. The connection strut V, shown in the right portion of FIG. 8, has a relatively thin wall 31 made of refined steel and presents, at the joining end 13, an internal flange 32 with threaded bores. The flange 16 extends through the wall 21 of the support housing G towards the interior and it has corresponding through holes, of which some contain centering pins 18, while into others the screwed traction anchors 23 are screwed from the interior of the support housing G up to the threaded bores of the internal flange 32. The joining place 33 is continuous on the outside and optionally packed or sealed.

In the left portion of FIG. 8, the connection of a connection strut V formed with a thick wall 31 is shown, which strut is used, for example, for the connection of the closing device E1. Because the closing device E1 requires relatively large forces for a stable bracing, the connection strut V is designed with a thick wall and in part even solid, and in addition an fitting sleeve 36 is inserted inside the joining place 33. Otherwise, the connection principle is the same as with the flange 16 shown in FIG. 8, on the right.

FIG. 9 illustrates, in a perspective view, the standardized star module N1, for example, of FIG. 6 for the outlet star or inlet star A, Z, which works according to the neck handling principle with gripper clamps to grip bottlenecks or mouths, and whose support housing G, above the two connection interfaces 6, is relatively high, and supports the support structure 29, to which a ring body, which carries the gripper clamps, is attached in a manner which allows replacement. Gripper clamps which can be actuated in a controlled manner are known, for example, from EP 0 939 044 B1 (FIG. 3).

In contrast, the standardized star module N2 in FIG. 10 presents a support housing G which has at least substantially the same external diameter d as the support housing in FIG. 9, although, above the connection interfaces 6, its height is considerably lower (height h), for the purpose of facilitating the glass handling transport principle with the support structure 29', which is designed differently.

In this case, the support structure 29' is formed from a star wheel which presents receiving packets, where the star wheel forms guide arcs, which surround its circumference, and where the bottles are supported by fixed transfer arcs on their floor surface (see EP 0 631 561 B1). Such transfer arcs can be seen in the embodiment according to FIG. 2. They are absolutely required, for example, if the bottles are transported without a bottom through a trunk gripping device which grips the bottle trunk. In this case, format dependent guide arcs are also not necessary. Suitable trunk gripping devices are known, for example, from EP 0 743 267 B1 or EP 0 795 500 B1.

The external diameters d of the support housing G. can be substantially identical, while their heights h are different. Both modules N1, N2 are compatible with the connection struts (V), as explained with reference to FIGS. 1-8.

We claim:

1. Transport system for container processing machines, particularly for bottle fillers, comprising inlet and outlet stars which can be driven and are arranged on columnar support housings and define a star configuration, the inlet and outlet stars defining container transport paths which are linked with the machine, wherein each support housing presents at least one connection interface to which a joining end of a respective one of a plurality of connection struts in the transport system is attached in a detachable fashion, another joining end of the respective one of the connection struts being connected to one of a connection interface of an additional support housing or of a machine substructure, whereby with the detachably connected connection struts the star configuration can be changed as desired in a modular manner.

2. Transport system according to claim 1, wherein the support housing presents one of a round or polygonal external contour.

3. Transport system according to claim 1, wherein, in the star configuration, the connection interfaces and the connection struts are placed in a common horizontal plane at a distance above the floor and at a distance below the transport path plane.

4. Transport system according to claim 3, wherein the support housing consists of two parts with one part positioned above the connection interfaces and another bottom part having the connection interfaces, and wherein the one part either can be replaced by another one part having another length or can be adjusted in length relative to the horizontal plane and the bottom part.

5. Transport system according to claim 1, wherein the support housing presents at least two connection interfaces which are mutually offset by an angle $\alpha$ of approximately 126°.

6. Transport system according to claim 1, wherein the support housing presents a single support foot.

7. Transport system according to claim 6, wherein the support foot is offset with respect to the column axis of the support housing.

8. Transport system according to claim 1, wherein an electromotor star drive is contained in the support housing.

9. Transport system according to claim 8, wherein in the support housing, an individual star drive being one of a servomotor with a gear drive or a direct drive motor is arranged and connected to a control and supply line which passes through the connection strut and leads to one of a control or supply unit.

10. Transport system according to claim 1, wherein at least one of drive lines, supply lines, or control lines are contained in the connection strut.

11. Transport system according to claim 1, wherein the connection struts are tubular and have an external pipe diameter larger than half the external diameter of the external contour of the support housing.

12. Transport system according to claim 1, wherein the support housing's connection interfaces include a flange, the external dimension of which corresponds to the external diameter of the connection strut, the connection strut being equipped at the joining end with an internal flange.

13. Transport system according to claim 12, wherein between the flange in the support housing connection interface and the joining end of the connection strut centering pins are inserted, and wherein the flange presents through holes for threaded tie rods.

14. Transport system according to claim 1, wherein the support housing above the plane of the connection interface is provided with at least one additional auxiliary connection device.

15. Transport system according to claim 1, wherein the star configuration can be changed by the addition or removal in a modular manner of at least one transfer star, the support housing for the at least one transfer star being connected in a detachable manner to at least one of the plurality of connection struts and with one of at least an additional support housing or with the machine substructure (1).

16. Transport system according to claim 1, wherein the star configuration can be changed in a modular manner by the addition or removal of at least one container processing assembly, wherein the support housing can be connected by means of at least one connection strut to at least one additional support housing or to the machine substructure.

17. Transport system according to claim 1, wherein a respective connection strut is equipped on the upper or the lower side with attachment points which can be uncovered as desired for attaching of one of peripheral accessory components or support legs.

* * * * *